US010125503B2

(12) United States Patent
Misiolek

(10) Patent No.: US 10,125,503 B2
(45) Date of Patent: Nov. 13, 2018

(54) SUSPENDED SCAFFOLD CABLE DIVERTER SYSTEM

(71) Applicant: SmithGroupJJR, Inc., Detroit, MI (US)

(72) Inventor: Jerome Andrew Misiolek, Dearborn, MI (US)

(73) Assignee: SmithGroupJJR, Inc., Detroit, MI (US)

( * ) Notice: Subject to any disclaimer, the term of this patent is extended or adjusted under 35 U.S.C. 154(b) by 533 days.

(21) Appl. No.: 14/317,919

(22) Filed: Jun. 27, 2014

(65) Prior Publication Data

US 2015/0001006 A1 Jan. 1, 2015

Related U.S. Application Data

(60) Provisional application No. 61/840,214, filed on Jun. 27, 2013.

(51) Int. Cl.
*E04G 5/00* (2006.01)
*E04G 3/34* (2006.01)

(52) U.S. Cl.
CPC *E04G 5/00* (2013.01); *E04G 3/34* (2013.01)

(58) Field of Classification Search
CPC .... E04G 3/00; E04G 3/34; E04G 3/26; E04G 3/22; E04G 5/00; E04G 5/041; E04G 5/006; B66C 23/00; B66C 23/06; B66C 23/26; B66C 23/205; B66C 23/20; B66C 23/201; B66C 23/202; B66C 23/82; B66C 23/54; B66C 19/00–19/02; B66C 17/00; B66C 17/04; B66C 17/06
See application file for complete search history.

(56) References Cited

U.S. PATENT DOCUMENTS 274,527 A * 3/1883 Stelle et al. ..... A61G 7/1046 212/230
1,961,119 A * 5/1934 Ettinger ..... A61G 7/1015 248/122.1
2,974,809 A * 3/1961 Sellars ..... B66C 23/48 212/203
3,181,707 A * 5/1965 Janssen ..... B66C 23/163 212/202

(Continued)

FOREIGN PATENT DOCUMENTS

WO 0169008 A2 9/2001

OTHER PUBLICATIONS

Davit Arm and "House Rig", printed Apr. 9, 2013.

(Continued)

*Primary Examiner* — Katherine W Mitchell
*Assistant Examiner* — Shiref M Mekaeil
(74) *Attorney, Agent, or Firm* — Brooks Kushman P.C.

(57) ABSTRACT

A suspended scaffold rigging system includes a base to be attached with a roof of a building and an arm attached with the base. The arm includes an end portion to extend over and away from an edge of the roof when the base is attached with the roof and a cable guide defined by the end portion. The system further includes a scaffold and a suspension cable to be attached to the scaffold, to be guided by the cable guide, and to be attached to a tie-back of the building such that that tie-back bears a load of the scaffold and the arm spaces the suspension cable away from the edge of the roof.

10 Claims, 4 Drawing Sheets

(56) References Cited

U.S. PATENT DOCUMENTS 3,804,263 A * 4/1974 Castonguay ..... B60P 1/548 212/180
4,050,587 A * 9/1977 Moen ..... B66C 23/48 212/301
4,068,827 A * 1/1978 Fanning ..... B66C 23/48 212/179
4,096,952 A * 6/1978 Diggs ..... B66C 23/201 212/176
4,560,074 A * 12/1985 Manning ..... B66C 23/203 212/179
5,341,898 A * 8/1994 Baziuk ..... E04G 3/34 182/142
5,762,083 A * 6/1998 Bate ..... B08B 9/043 134/167 C
5,934,490 A * 8/1999 Mora ..... B25H 1/0007 212/176
5,975,499 A * 11/1999 Ostrobrod ..... A62B 1/06 211/196
6,189,866 B1 * 2/2001 Harkins ..... B66C 23/44 212/176
6,830,423 B1 * 12/2004 Williams ..... B60P 1/5471 212/180
6,978,974 B1 * 12/2005 Marasco ..... A63H 17/12 248/124.1
7,350,770 B1 * 4/2008 Boyer ..... B66C 23/02 212/295
7,537,088 B2 * 5/2009 Spitsbergen ..... B66C 23/208 187/240
8,684,136 B2 * 4/2014 Chilton ..... A62B 1/06 182/3
8,684,335 B2 * 4/2014 Hayes ..... B66C 23/48 254/323
2002/0066710 A1 * 6/2002 Spitsbergen ..... B66C 23/44 212/179
2003/0116518 A1 * 6/2003 Austin ..... B66C 23/166 212/180
2005/0051507 A1 * 3/2005 Haliburda, III ..... B66C 23/208 212/179
2006/0045704 A1 * 3/2006 Laufenberg ..... B60P 1/548 414/543
2006/0120842 A1 * 6/2006 Thompson ..... B60P 1/5433 414/462
2006/0163186 A1 * 7/2006 Choate ..... B66C 23/166 212/175
2009/0159734 A1 6/2009 Romo
2013/0048424 A1 * 2/2013 Bemis ..... E04G 3/32 182/18
2013/0284688 A1 * 10/2013 Narcisco ..... B66C 23/166 212/175

OTHER PUBLICATIONS

Outrigger Beam on "A" Frame, printed Apr. 17, 2013.
Outrigger Beam on Pipe Scaffold Frame, printed Apr. 17, 2013.
Parapet Clamp, printed Apr. 17, 2013.

* cited by examiner

SUSPENDED SCAFFOLD CABLE DIVERTER SYSTEM

CROSS-REFERENCE TO RELATED APPLICATION

This application claims the benefit of U.S. Provisional Application No. 61/840,214, filed Jun. 27, 2013, the disclosure of which is hereby incorporated in its entirety by reference herein.

TECHNICAL FIELD

This disclosure relates to cable diverter systems for roof suspended scaffolding.

BACKGROUND

A davit is a mechanical structure used to lower objects over an edge of a drop-off, such as a scaffold down a building or a lifeboat over a ship.

SUMMARY

A suspended scaffold rigging system includes a base configured to be attached with a roof of a building, and an arm attached with the base. The arm includes an end portion configured to extend over and away from an edge of the roof when the base is attached with the roof, and a cable guide defined by the end portion. The system further includes a scaffold and a suspension cable configured to be attached to the scaffold, to be guided by the cable guide, and to be attached to a tie-back of the building such that that tie-back bears a load of the scaffold and the arm spaces the suspension cable away from the edge of the roof.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
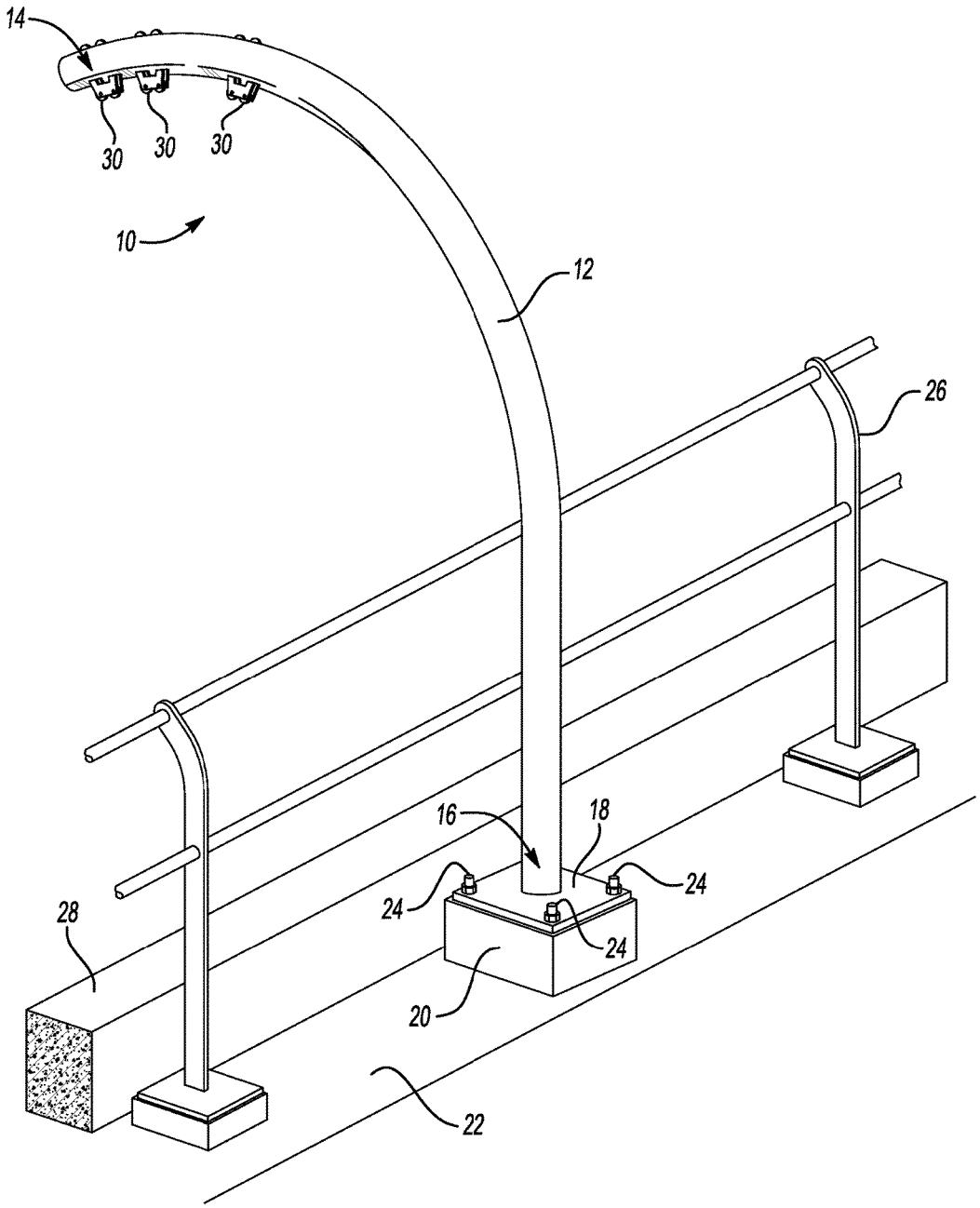
FIG. 1 is a perspective view of a conventional davit system attached to a roof of a building.

Referring to FIG. 1, a conventional davit system 10 includes an arm 12 (curved steel tubing in this example) having a suspension end 14 and a base end 16. The base end 16 includes a flange 18, which is bolted to a davit base 20 of a roof 22 via bolts 24. The suspension end 14 extends above and over a guardrail 26 and parapet 28 of the roof 22 and includes suspension hooks 30 to which rigging (not shown) for a suspended scaffold (not shown) is attached. The davit system 10 thus allows a suspended scaffold and rigging to be attached to the roof 22 without the rigging resting upon the guardrail 26 or parapet 28. (Such guardrails and parapets may not be able to bear the loads associated with a suspended scaffold and rigging.)

The davit system 10 is designed such that loads from a suspended scaffold and rigging attached to the suspension hooks 30 are transferred down the arm 12 to the davit base 20 and roof 22. That is, the davit system 10 is designed to bear the loads of a suspended scaffold and rigging attached thereto.

Certain roofs may not be properly reinforced to bear the loads transferred to them via conventional davit systems. Such reinforcement may increase roof costs and limit architectural and design freedom.

Figure 2:
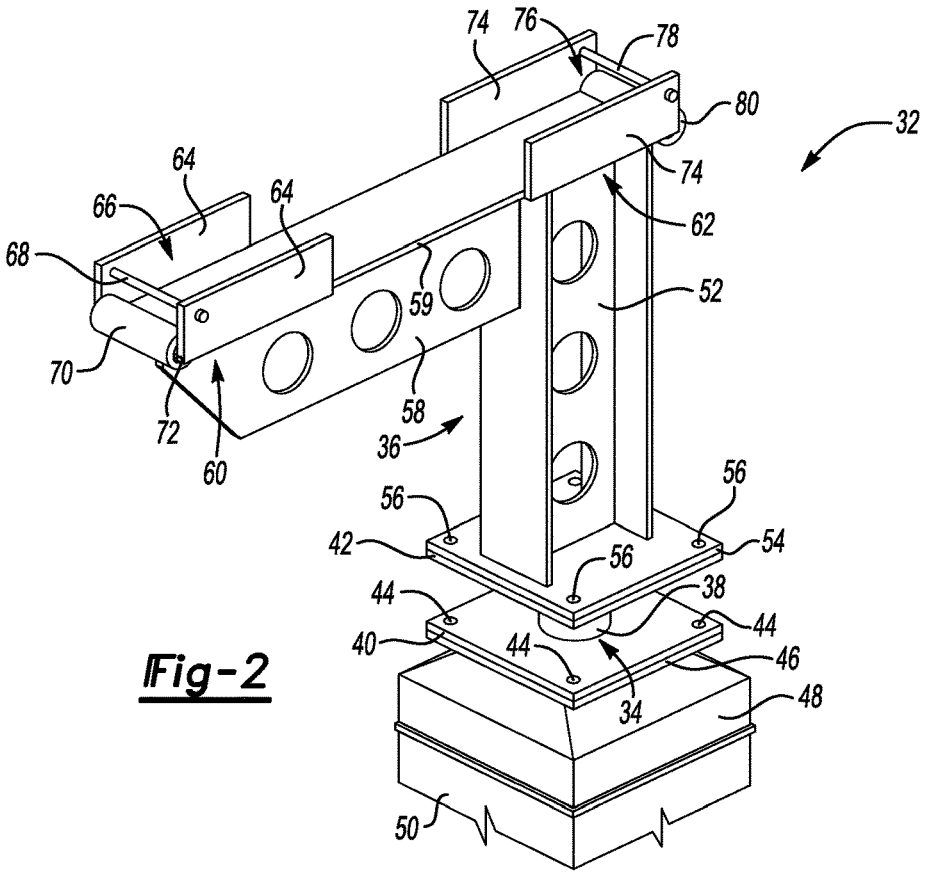
FIG. 2 is a perspective view of an arm of a cable diverter system.
Figure 3:
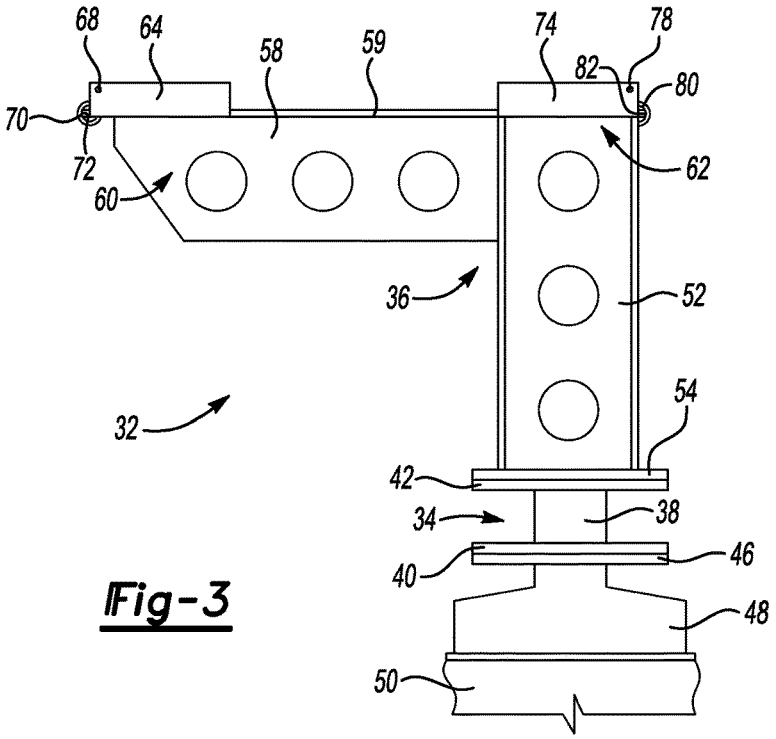
FIG. 3 is a side view of the arm of FIG. 2.

Referring to FIGS. 2 and 3, a cable diverter system 32 includes a base adapter 34 and an arm 36. The base adapter 34 includes, in this example, a support shaft 38 (or other structural member) with flanges 40, 42 disposed at opposing ends of the support shaft 38. The flange 40 defines bolt holes 44 and is configured to be mechanically fastened (e.g., bolted) to a flange 46 of a davit base 48 associated with a roof 50 via the bolt holes 44. (A socket similar to that shown in FIG. 1, for example, may also be used instead of a flange depending on whether the base adapter 34 is to be attached to a davit base or some other roof structure, etc.)

The arm 36, in this example, is partially formed from a perforated steel wide flange I-beam 52 arranged to extend away from the davit base 48, and includes a flange 54 disposed at an end thereof. The flange 54 defines bolt holes 56 and is configured to be mechanically fastened (e.g., bolted) to the flange 42 of the base adapter 34. The arm 36 is further formed from a perforated steel T-beam 58 (having a hat section 59) attached to an end of the I-beam 52 opposite the flange 54 and arranged to extend generally perpendicularly away from the I-beam 52. The arm 36 thus has a diverter portion 60 that extends above and over an edge of the roof 50 when the arm 36 is attached to a davit base, such as the davit base 48, located near an edge of the roof 50, and has a rear portion 62 opposite the diverter portion 60.

A pair of plates 64 extending generally perpendicularly away from the hat section 59 is attached to sides of the hat section 59 at the diverter portion 60 so as to form a trough or cavity 66. A retention bar 68 spans between and is attached to the plates 64. As discussed more below, cabling of a suspended scaffold passes through the cavity 66, between the hat section 59 and retention bar 68, and is retained by the plates 64 and retention bar 68.

A rounded member 70 (e.g., a pipe section) is attached to an end of the diverter portion 60 such that the hat section 59 extends radially into and supports an inner wall 72 of the rounded member 70. The rounded member 70 is spaced away from and is generally disposed underneath the retention bar 68. The rounded member 70 provides a rounded surface to help prevent any cabling resting thereon from kinking.

A pair of plates 74 extending generally perpendicularly away from the hat section 59 is attached to sides of the hat section 59 at the rear portion 62 so as to form a trough or cavity 76 in registration with the cavity 66. A retention bar 78 spans between and is attached to the plates 74. As discussed more below, cabling of a suspended scaffold may pass through the cavity 76, between the hat section 59 and retention bar 78, and be retained by the plates 74 and retention bar 78 if a tie-back used in concert with the arm 36 is positioned below the arm 36.

A rounded member 80 (e.g., a pipe section) is attached to an end of the end portion 62 such that the hat section 59 extends radially into and supports an inner wall 82 of the rounded member 80. The rounded member 80 is spaced away from and is generally disposed underneath the retention bar 78. The rounded member 80 provides a rounded surface to help prevent any cabling resting thereon from kinking.

Figure 4:
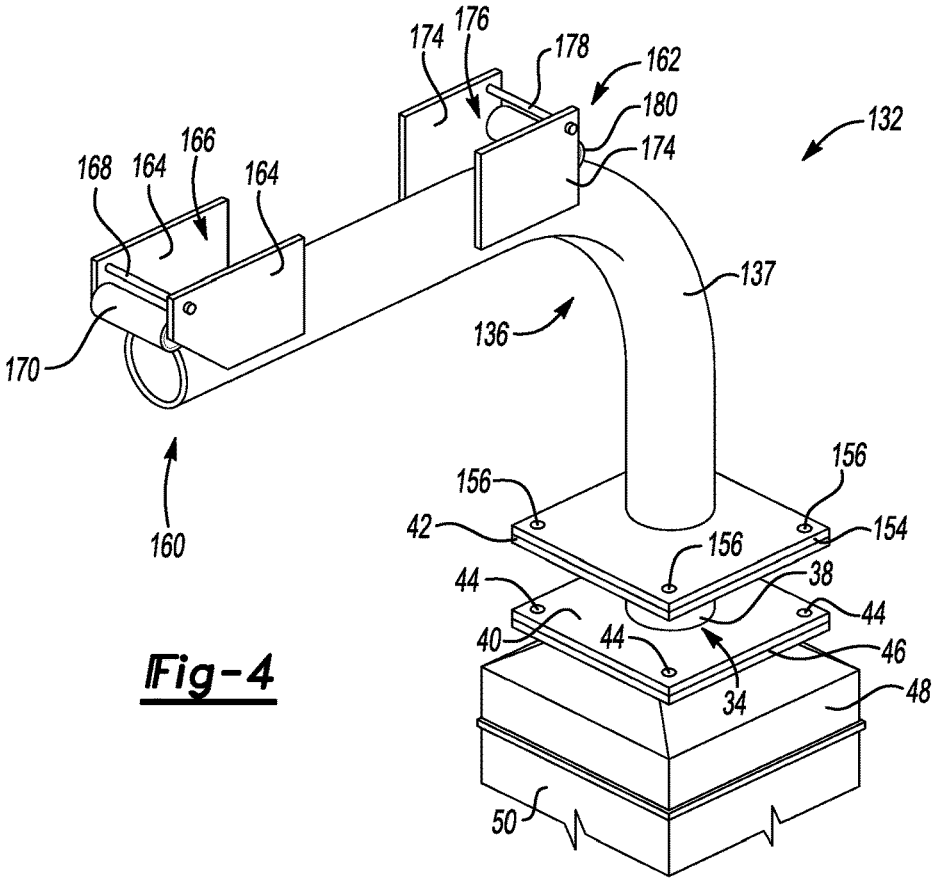
FIG. 4 is a perspective view of an arm of a cable diverter system.
Figure 5:
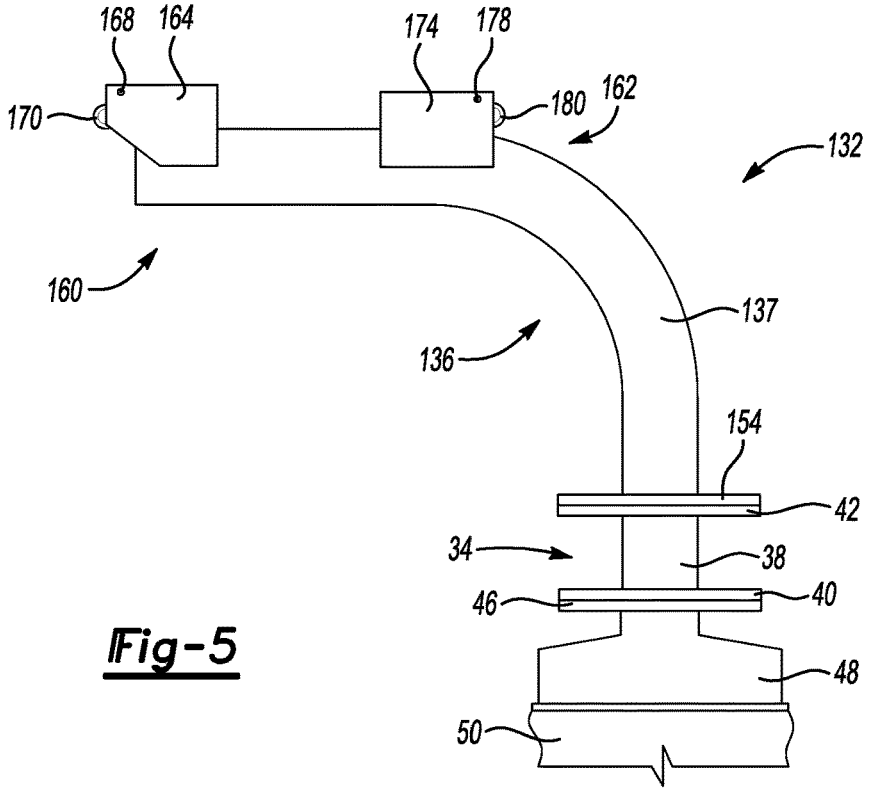
FIG. 5 is a side view of the arm of FIG. 4.

Referring to FIGS. 4 and 5, elements sharing numbers similar to FIGS. 2 and 3 have similar descriptions. A cable diverter system 132 includes an arm 136. The arm 136, in this example, is formed from a bent steel tube 137 arranged to extend away from the davit base 48 and includes a flange 154 disposed at an end thereof. The flange 154 defines bolt holes 156 and is configured to be mechanically fastened (e.g., bolted) to the flange 42 of the base adapter 34. (That is, the arms 36, 136 are interchangeable with the base adapter 34.) The arm 136 thus has a diverter portion 160 that extends above and over an edge of the roof 50 when the arm 136 is attached to a davit base, such as the davit base 48, located near an edge of the roof 50, and has a rear portion 162 opposite the diverter portion 160.

A pair of plates 164 extending away from the tube 137 is attached tangentially to opposite sides of the tube 137 at the diverter portion 160 so as to form a trough or cavity 166. A retention bar 168 spans between and is attached to the plates 164. Cabling of a suspended scaffold passes through the cavity 166, between the tube 137 and retention bar 168, and is retained by the plates 164 and retention bar 168.

A rounded member 170 (e.g., a pipe section) spans between and is attached to the plates 164. The rounded member 170 is spaced away from and is generally disposed underneath the retention bar 168. The rounded member 170 provides a rounded surface to help prevent any cabling resting thereon from kinking.

A pair of plates 174 extending away from the tube 137 is attached tangentially to opposite sides of the tube 137 at the rear portion 162 so as to form a trough or cavity 176 in registration with the cavity 166. A retention bar 178 spans between and is attached to the plates 174. As discussed more below, cabling of a suspended scaffold may pass through the cavity 176, between the tube 137 and retention bar 178, and be retained by the plates 174 and retention bar 178 if a tie-back used in concert with the arm 136 is positioned below the arm 136.

A rounded member 180 (e.g., a pipe section) spans between and is attached to the plates 164. The rounded member 180 is spaced away from and is generally disposed underneath the retention bar 178. The rounded member 180 provides a rounded surface to help prevent any cabling resting thereon from kinking.

Figure 6:
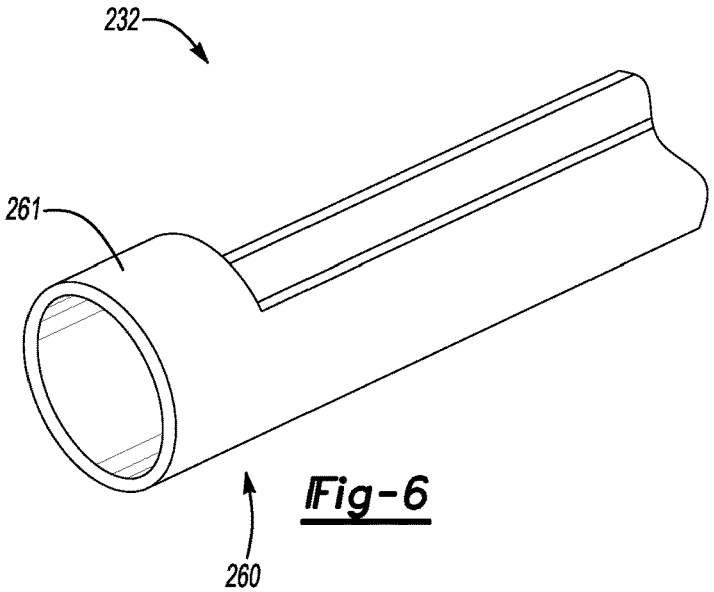
FIG. 6 is a perspective view of a diverter portion of a cable diverter system.

Other arms are also contemplated. Certain arms, for example, may be configured to be directly attached with a davit base or other roof structure (thus eliminating the need for a base adapter or davit base). The arms can be formed from any suitable material (e.g., composite, etc.) having any suitable shape (e.g., triangular, square, etc.). Tubing (complete or sectioned and with or without retention bars) may be used instead of plates 64, 74, 164, 174 to form troughs or cavities that assist in retaining scaffold cabling. Referring to FIG. 6 for example, an arm 232 includes a diverter portion 260 formed from an open tube having a closed end 261. Scaffold cabling is threaded through and retained by closed end 261. Other alternatives are also possible.

Figure 7:
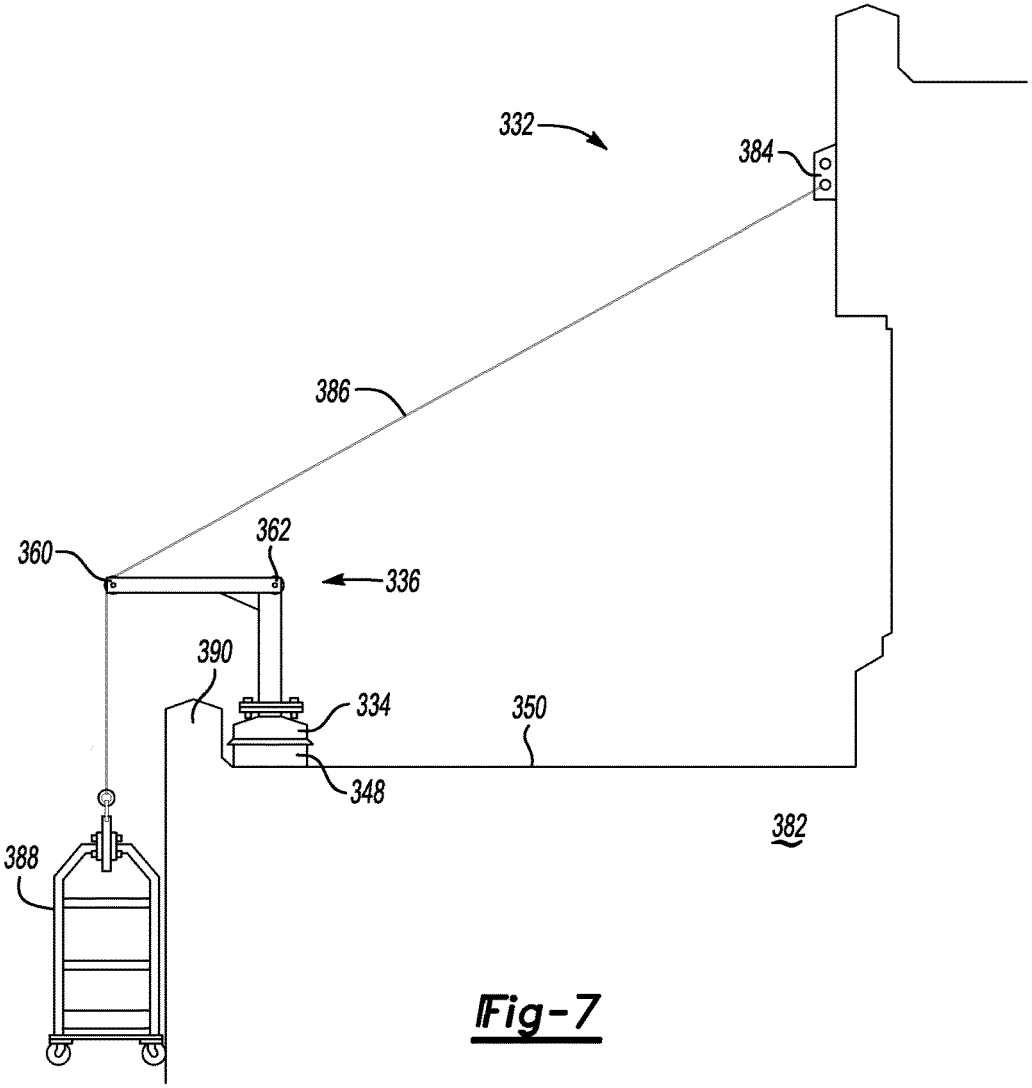
FIG. 7 is a schematic view of a cable diverter system attached to a building.

Referring to FIG. 7, elements sharing numbers similar to FIGS. 2 through 6 have similar descriptions. A cable diverter system 332 includes a base adapter 334 attached to a davit base 348 associated with roof 350 of building 382, an arm 336 including a diverter portion 360 and rear portion 362, and a tie-back 384 (e.g., a steel beam) structurally attached to the building 382 (e.g., attached to a girder of the building 382). Cabling 386 of a suspended scaffold system is attached (anchored) to the tie-back 384, threaded over the diverter portion 360, and attached to a suspended scaffold 388 such that the cabling 386 is diverted over and away from a parapet 390 associated with the roof 350.

In contrast to conventional davit systems, arm 336 does not bear all of the loads of the suspended scaffold system. Rather, the arm 336 only bears that portion of the loads associated with diverting the cabling 386 over and away from the parapet 390: the tie-back 384 bears the bulk of the loads. Thus, the roof 350 need not be reinforced to bear all of the loads—potentially reducing roof cost and increasing architectural and design freedom.

Because the tie-back 384 is positioned at an elevation above the arm 336, the cabling 386 is only threaded over the diverter portion 360. If, in other arrangements, the tie-back 384 is positioned at an elevation below the arm 336, the cabling 386 may be threaded over the diverter and rear portions 360, 362. Other arrangements are also contemplated.

The words used in the specification are words of description rather than limitation, and it is understood that various changes may be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A suspended scaffold rigging system comprising:

a base configured to be attached with a roof of a building;

an arm attached with the base and including (i) an end portion configured to extend over and away from an edge of the roof when the base is attached with the roof and (ii) a cable guide defined by the end portion and including plates extending in a direction opposite of the roof and arranged to at least partially define a cavity;

a scaffold; and a suspension cable attached to the scaffold, passing through the cavity, guided by the plates, and attached to a tie-back not directly connected to the roof of the building such that the tie-back bears a load of the scaffold and the arm spaces the suspension cable away from the edge of the roof.

2. The system of claim 1 wherein the cable guide further includes a retention member spanning the plates and configured to prevent the suspension cable from dislodging from the cable guide.

3. The system of claim 1, wherein the cable guide further includes a curved edge portion to prevent the suspension cable from kinking.

4. The system of claim 3, wherein the end portion includes an inner wall and the curved edge portion is reinforced by the inner wall.

5. The system of claim 1 further comprising an other cable guide defined by the arm.

6. The system of claim 5, wherein the other cable guide includes other plates arranged to partially define an other cavity through which the suspension cable passes when the end portion is at an elevation greater than the tie-back.

7. The system of claim 6, wherein the other cable guide further includes a retention member spanning between the other plates and configured to prevent the suspension cable from dislodging from the other cable guide.

8. The system of claim 5, wherein the suspension cable passes through the other cable guide when the end portion is at an elevation greater than the tie-back.

9. The system of claim 1, wherein the base is a flange.

10. The system of claim 1, wherein the base is a socket.

* * * * *